US010427451B1

(12) United States Patent
Termun, Jr.

(10) Patent No.: US 10,427,451 B1
(45) Date of Patent: Oct. 1, 2019

(54) PAINT ROLLER BRUSH CLEANING DEVICE

(71) Applicant: Michael Termun, Jr., Ewing, NJ (US)

(72) Inventor: Michael Termun, Jr., Ewing, NJ (US)

( * ) Notice: Subject to any disclaimer, the term of this patent is extended or adjusted under 35 U.S.C. 154(b) by 0 days.

(21) Appl. No.: 15/871,477

(22) Filed: Jan. 15, 2018

(51) Int. Cl.
*B44D 3/00* (2006.01)
*A46B 17/06* (2006.01)
*B08B 3/04* (2006.01)

(52) U.S. Cl.
CPC ..... *B44D 3/006* (2013.01); *A46B 17/06* (2013.01); *B08B 3/04* (2013.01)

(58) Field of Classification Search
CPC ..... B44D 3/006; B08B 3/04; A46B 17/06; B05C 17/02; B05C 17/0245
See application file for complete search history.

(56) References Cited

U.S. PATENT DOCUMENTS 3,696,457 A 10/1972 Hand
4,294,272 A 10/1981 Klaiber
4,641,673 A * 2/1987 Conley ..... B44D 3/006 134/138
5,050,626 A 9/1991 Brockage
5,185,938 A * 2/1993 Hutt ..... A46B 17/06 15/246
2013/0206191 A1 8/2013 Rhines

OTHER PUBLICATIONS

Ryobi Wants to Clean Your Paint Brushes, (Johnson, Benjamen) Nov. 12, 2009, [online], [retrieved on Nov. 2, 2017] Retrieved from the Internet <URL: http://toolmonger.com/2009/11/12/ryobi-wants-to-clean-your-paint-brushes/>.
Rollerwringer Paint roller cleaner, (rollerwringer29_8 (0 )) Nov. 2, 2017, [online], [retrieved on Nov. 2, 2017] Retrieved from the Internet <URL: https://www.ebay.com/itm/>.

* cited by examiner

*Primary Examiner* — Spencer E Bell
(74) *Attorney, Agent, or Firm* — Cramer Patent & Design, PLLC; Aaron R. Cramer

(57) ABSTRACT

A paint roller brush cleaning device utilizes a multicompartment tank and lid. The lid has an aperture configured to accommodate the insertion of a roller brush into the interior environment of the tank. The aperture is in environmental communication with an angular track disposed upon the lid. The interior environment of the tank is partitioned into four fluid retention compartments and a single dry storage compartment. An electrical drill adapter is provided to enable the attachment of a paint roller brush thereby permitting the adapter and paint roller brush to navigate the angular track and plurality of interior compartments.

7 Claims, 5 Drawing Sheets

PAINT ROLLER BRUSH CLEANING DEVICE

RELATED APPLICATIONS

Not applicable.

FIELD OF THE INVENTION

The present invention relates generally to the field of receptacles for enabling the cleaning of a paint roller brush.

BACKGROUND OF THE INVENTION

All of us know of the burdens, difficulty and painstaking patience required when performing a painting project. Depending on the particular project, there are a variety of tasks to perform, from removing old paint, cleaning the surface, prepping the surface, mixing the paint, applying the paint and the like. However, perhaps the most dreaded of all of these tasks is the cleanup. And perhaps the most problematic items to clean are the brush and roller itself. No matter how much soaking, scrubbing, cleaning and the like that occurs, a small amount of paint always remains forever trapped in the bristles or the paint roller cover. Just when one is expecting a final clear rinse, colored paint is still coming out. Thus, repeated time must be spent washing and subsequently re-rinsing the item until one gives up and is satisfied with "clean enough". Of course, all of this washing and rinsing time means excessive usage of water, which is a limited natural resource. If the brush or roller cover should be simply discarded, it ends up in a landfill, where it may pose a possible hazardous waste scenario. Accordingly, there is a need for a means by which brushes and paint roller covers can be easily and completely cleaned after use. The development of the apparatus fulfills this need.

SUMMARY OF THE INVENTION

The principles of the present invention provide for a reservoir with an interior that is subdivided into different compartments, each capable of holding a cleaning solution therein. The reservoir includes a continuous sidewall with a perimeter rim. A lid has a perimeter flanged rim that is capable or mating with the rim on the reservoir sidewall and a travel track and an entry removal point that permits access to the reservoir interior. In certain embodiments, the reservoir rim has at least one (1) attachment point and the lid has at least one (1) latching handle. Each latching handle removably attaches the lid to the attachment onto on the reservoir. A driving tool coupling enables a driving tool to attach to a paint roller brush and transfer rotational movement thereto. When assembled, the driving tool coupling enables the paint roller brush to be within the reservoir interior while the driving tool is external from the lid.

A further object of the invention is to provide such a reservoir interior that is divided into a first wash area, a second wash area, a third wash area, a drying area, and a storage area. In a preferred embodiment, the storage area is larger than the other areas. The travel track is aligned with each wash area and the drying area, such that when the driving tool operates the paint roller brush when the lid is on, the paint roller brush can be selectively operated in any of the aligned wash or drying areas.

Another object of the invention is to provide such a driving tool coupling that includes a central shaft, with a first end capable of being coupled to the driving tool and a second end. A spacer shield is held between a first and a second bearing and has a diameter larger than a diameter of the entry removal point. A brush holder is affixed to the shaft at the second end and retained with a fastener. A grip is disposed between one (1) of the bearings and the brush holder. The brush holder removably attaches to the paint roller brush.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
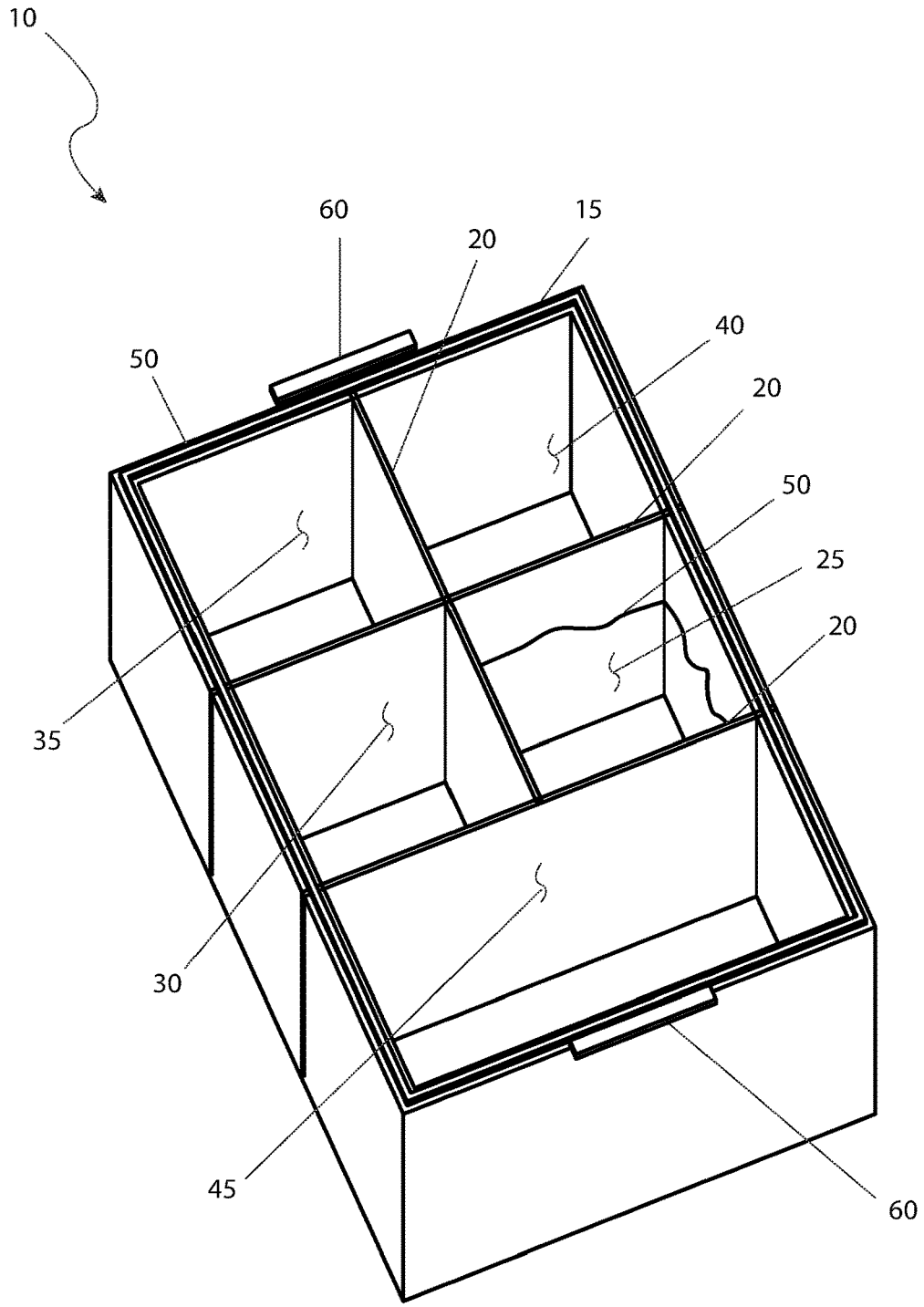
FIG. 1 is a perspective view of the divided tub 15 as used with the paint roller and paint brush cleaning apparatus 10, according to the preferred embodiment of the present invention.

10 paint roller and paint brush cleaning apparatus
15 divided tub
20 divider
25 first wash area
30 second wash area
35 third wash area
40 spin dry area
45 storage area
50 washing liquid
55 reinforced rim
60 attachment point
65 lid
70 flanged lid perimeter
75 latching handle
80 access travel track
85 entry/removal point
90 first usage area
95 second usage area
100 third usage area
105 fourth usage area
110 paint brush/roller holder
115 center shaft
120 drill connection end
125 lid spacer shield
130 first bearing
135 second bearing
140 grip
145 brush holder
150 roller cover holder
155 securing nut

160 drill
165 user
170 paint roller cover
175 rotational vector
180 centripetal force

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, a perspective view of the divided tub 15, as used with the apparatus 10, according to the preferred embodiment of the present invention is disclosed. The paint roller and paint brush cleaning apparatus 10 (herein also described as the "apparatus") 10, includes a plastic tub with the approximate overall dimensions of seventeen and a half inches (17½ in.) long, twelve inches (12 in.) wide, and twelve inches (12 in.) tall. It is envisioned to be made of plastic in an injection or blow molding process, although other materials such as galvanized steel could also be used. As such, the material of construction used with the divided tub 15 is not intended to be a limiting factor of the present invention. The interior of the divided tub 15 is provided with dividers 20 which segment the divided tub 15 into five (5) usage areas as follows: a first wash area 25, a second wash area 30, a third wash area 35, a spin dry area 40, and a storage area 45. The first wash area 25, the second wash area 30, the third wash area 35 and the spin dry area 40 comprise an area of approximately five and a half square inches (5½ in.2). The first wash area 25, the second wash area 30, and the third wash area 35 are filled with a washing liquid 50, such as water, or a soap/water mixture. Further details on the usage of the divided tub 15 will be provided herein below. The divided tub 15 is provided with a reinforced rim 55 that provides for at least two (2) attachment points 60.

Figure 2:
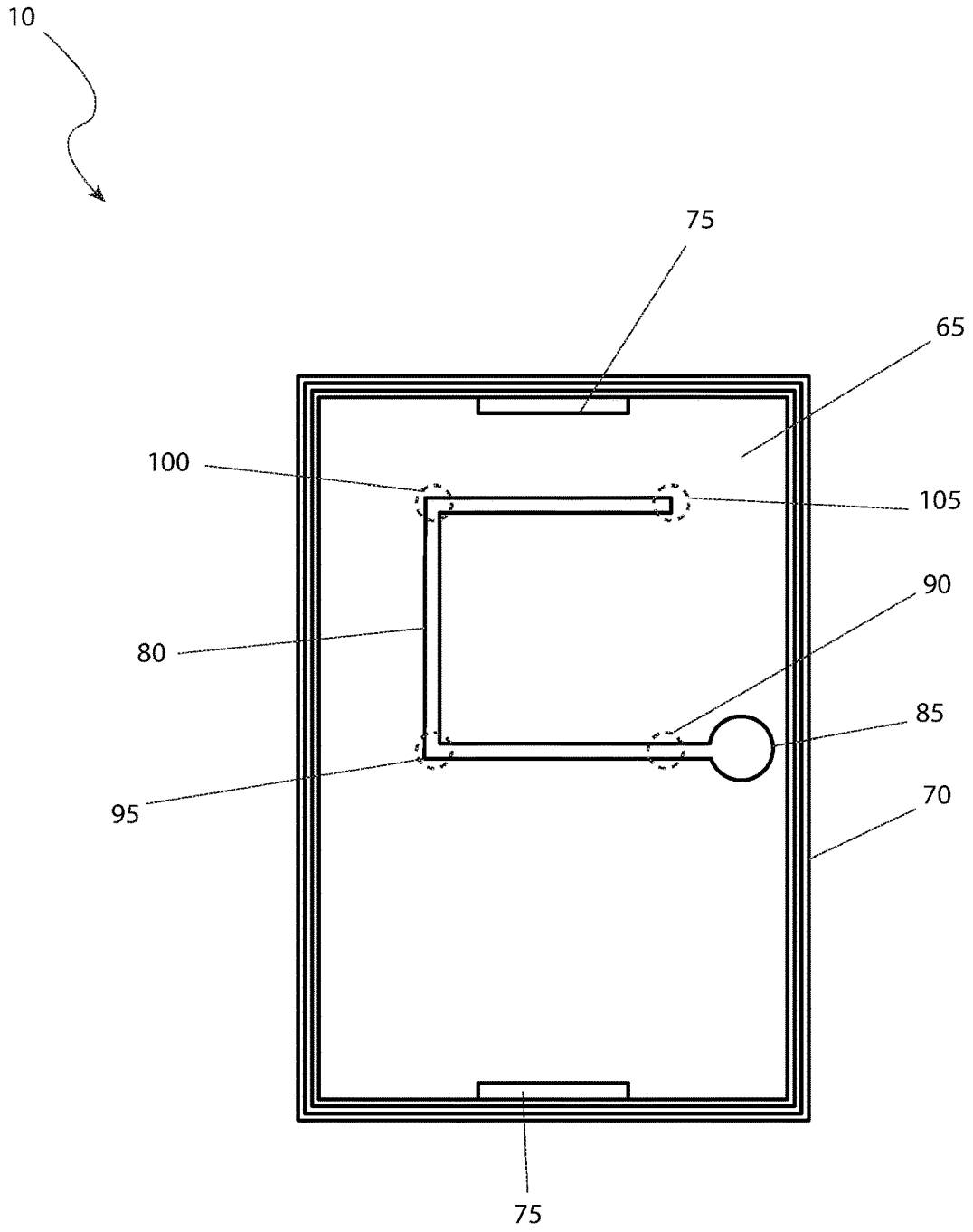
FIG. 2 is a is a perspective view of the lid 65 as used with the paint roller and paint brush cleaning apparatus 10, according to the preferred embodiment of the present invention.

Referring next to FIG. 2, a perspective view of the lid 65 as used with the apparatus 10, according to the preferred embodiment of the present invention is depicted. The lid 65 is designed to fit atop the divided tub 15 (as shown in FIG. 1) via a friction fit method that mates a flanged lid perimeter 70 with the reinforced rim 55 (as shown in FIG. 1). The lid 65 is placed and removed via latching handle 75 that mates with the attachment points 60 (as shown in FIG. 1). The lid 65 is provided with an access travel track 80 with an entry/removal point 85 located at one (1) end. The entry/removal point 85 is provided with a first usage area 90 that corresponds to the center of the first wash area 25 (as shown in FIG. 1), a second usage area 95 that corresponds to the center of the second wash area 30 (as shown in FIG. 1), a third usage area 100 that corresponds to the center of the third wash area 35 (as shown in FIG. 1), and a fourth usage area 105, that corresponds to the center of the spin dry area 40 (as shown in FIG. 1). The access travel track 80 is used by a paint brush/roller holder 110 (described in FIG. 3) in a manner that utilizes the lid 65 to shield the user against accidental splashes.

Figure 3:
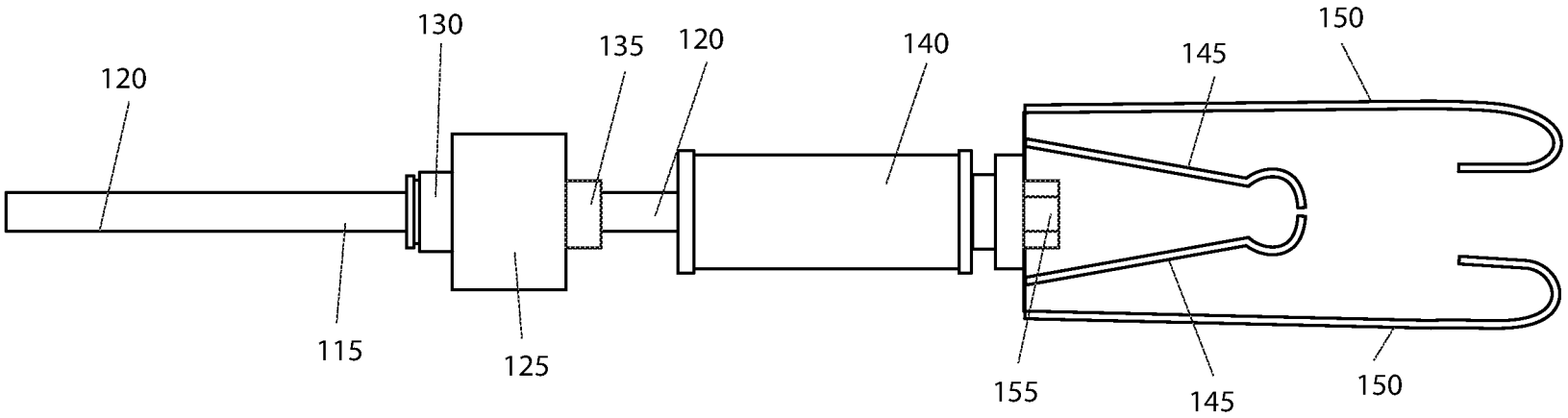
FIG. 3 is a side view of the paint brush/roller holder 110, as used with the paint roller and paint brush cleaning apparatus 10, according to the preferred embodiment of the present invention.

Referring now to FIG. 3, a side view of the paint brush/roller holder 110, as used with the apparatus 10, according to the preferred embodiment of the present invention is shown. The paint brush/roller holder 110 is designed to connect into a standard drill and utilizes a center shaft 115 with a drill connection end 120 at the proximal end. Next, a lid spacer shield 125 is held captive by a first bearing 130 and a second bearing 135. A grip 140 is provided on the midpoint on the paint brush/roller holder 110 to allow for ease of holding when inserting or removing rollers or brushes (not shown). Finally, a brush holder 145 is mounted inside of a roller cover holder 150 in a tandem arrangement and held captive by a securing nut 155 to the distal end of the center shaft 115. The brush holder 145 and the roller cover holder 150 operate in a typical manner as other holders found on the market and are well known in the art. The paint brush/roller holder 110 can be used with any make or model of drill, either operated by AC power or powered by a rechargeable battery.

Figure 4:
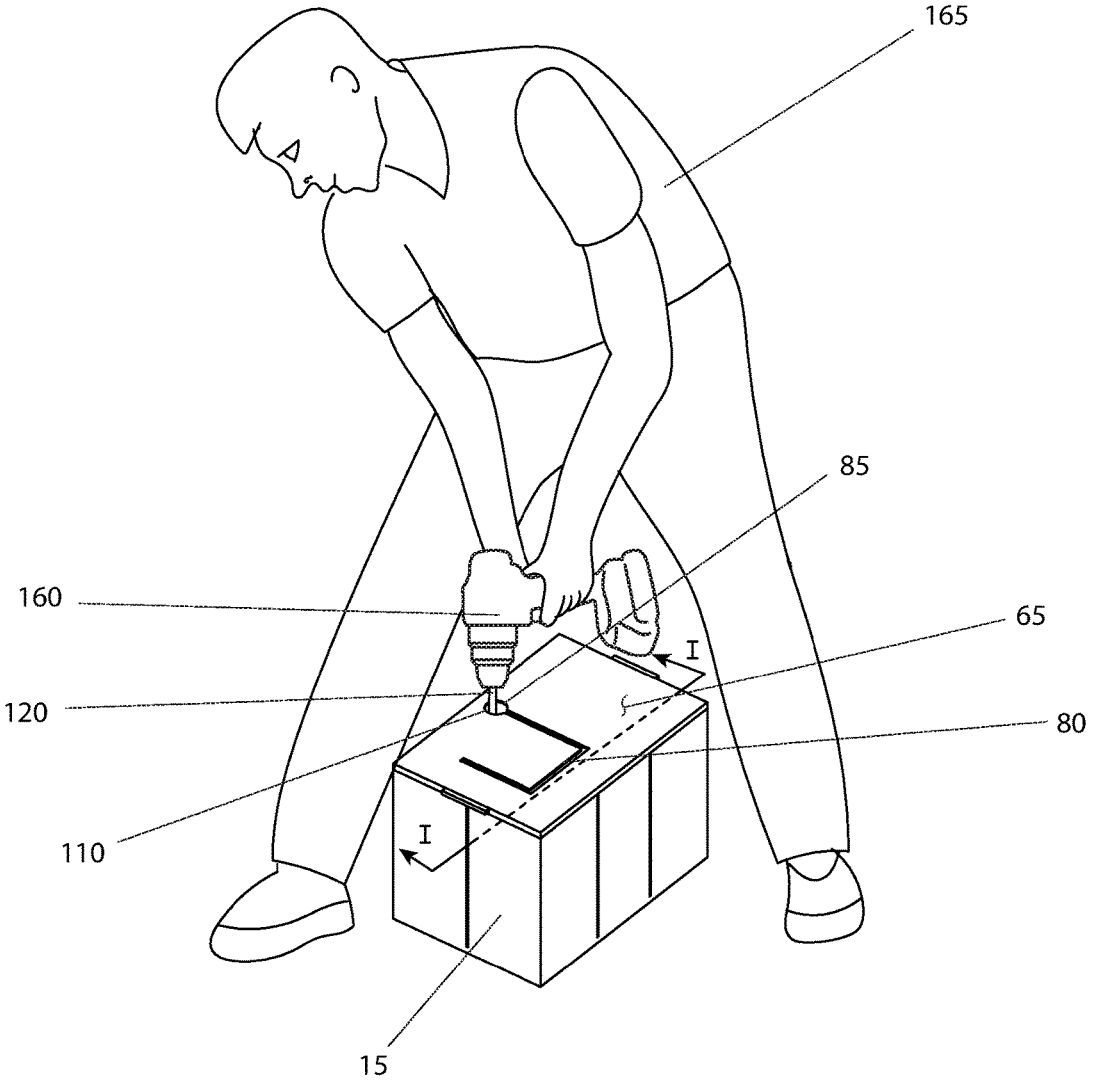
FIG. 4 is a perspective view of the paint roller and paint brush cleaning apparatus 10, shown in a utilized state, according to the preferred embodiment of the present invention; and, FIG. 5 is a sectional view of the paint roller and paint brush cleaning apparatus 10, as seen along a line I-I, as shown in FIG. 4, according to the preferred embodiment of the present invention.

Referring next to FIG. 4, a perspective view of the apparatus 10, shown in a utilized state, according to the preferred embodiment of the present invention is disclosed. The drill connection end 120 of the paint brush/roller holder 110 is chucked into a drill 160 while inserted through the entry/removal point 85 and routed along the access travel track 80. A paint brush or roller cover (not seen due to illustrative limitations) is placed on the distal end of the paint brush/roller holder 110 and is within the divided tub 15 and shielded by the lid 65. The lid spacer shield 125 restricts movement of the drill 160 through the lid 65 and within the divided tub 15. A user 165 then operates the drill 160 in a customary manner at high revolutions per minute. This operation is envisioned to occur for approximately forty-five to sixty seconds (45-60 s.) in the first wash area 25 (as shown in FIG. 1), the second wash area 30 (as shown in FIG. 1), the third wash area 35 (as shown in FIG. 1), and the spin dry area 40 (as shown in FIG. 1) each.

Figure 5:
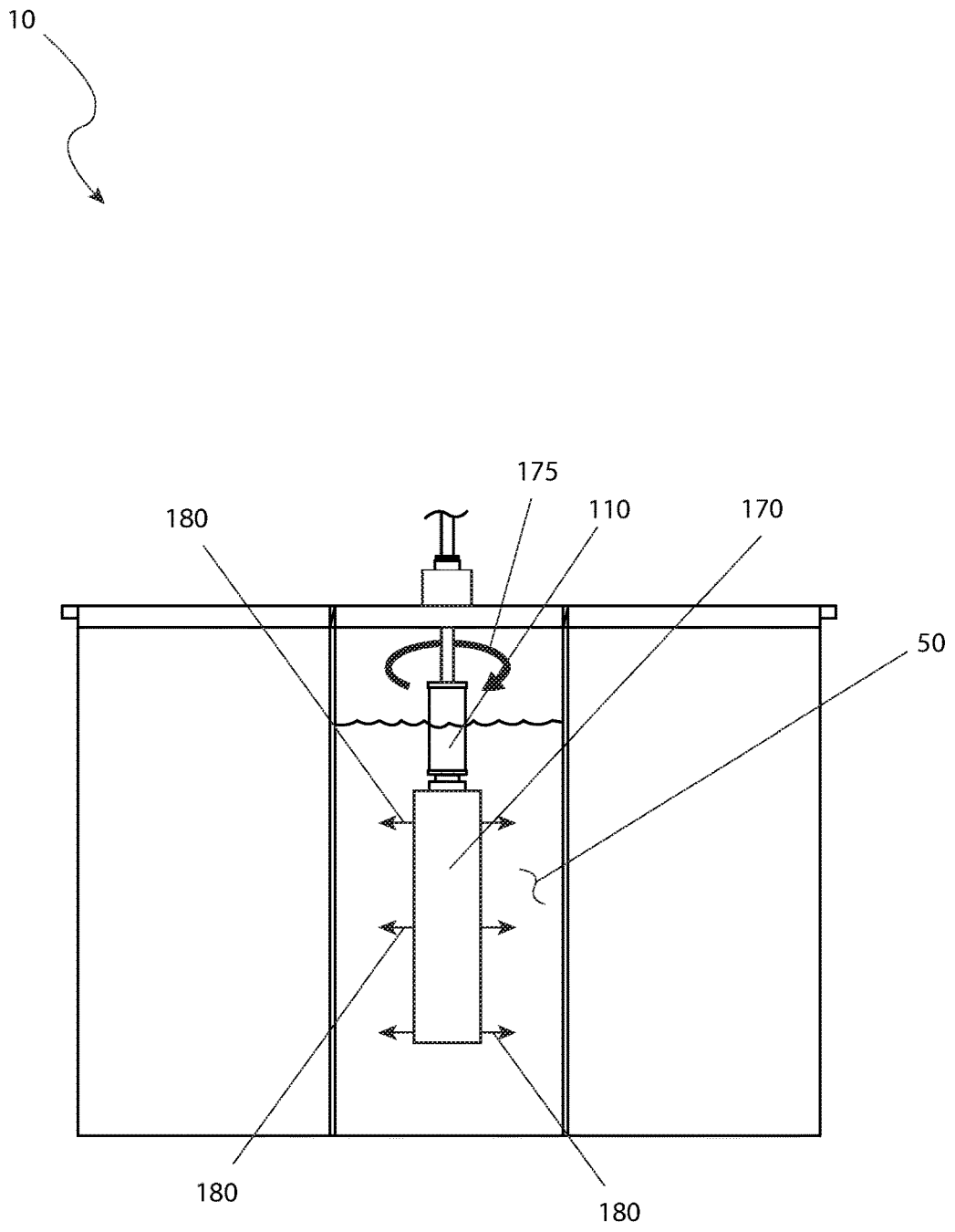

Referring finally to FIG. 5, a sectional view of the paint roller and paint brush cleaning apparatus 10, as seen along a line I-I, as shown in FIG. 4, according to the preferred embodiment of the present invention is depicted. A paint roller cover 170 is shown attached to the distal end of the paint brush/roller holder 110. A paint brush could be utilized in an equivalent manner, and as such, should not be interpreted as a limiting factor of the present invention. As a rotational vector 175 is applied via the drill 160 (as shown in FIG. 4), the paint roller cover 170 reacts with the washing liquid 50 to cause paint and other foreign material to be emitted along the lines of centripetal force 180. Such cleaning action is accomplished sequentially in the first wash area 25 (as shown in FIG. 1), the second wash area 30 (as shown in FIG. 1), and the third wash area 35 (as shown in FIG. 1). It is envisioned that the third wash area 35 (as shown in FIG. 1) may be filled only with rinse water. When the paint roller cover 170 is moved to the spin dry area 40 (as shown in FIG. 1), it is dried by the same spinning action.

The preferred embodiment of the present invention can be utilized by the common user in a simple and effortless manner with little or no training. It is envisioned that the apparatus 10 would be constructed in general accordance with FIG. 1 through FIG. 5.

The user would procure the apparatus 10 through normal purchasing methods, with the specific interest of allowing for the complete and thorough cleaning of used paint brushes and paint rollers 110, saving money on brush and roller replacement, reducing aggravation and time using conventional cleaning methods, saving of natural resources, and reducing waste in landfills.

After procurement and prior to utilization, the apparatus 10 would be prepared in the following manner: the first wash area 25, the second wash area 30, and the first wash area 25 would be filled with washing liquid 50 including but not limited to: water, water/soap combination, oil-based paint cleaning methods, or similar liquid.

During utilization of the apparatus 10, the following procedure would be initiated: the paint brush/roller holder 110 would be inserted through the entry removal point 85 of the lid 65; the paint roller cover 170 or paint brush would be inserted in the brush holder 145 or roller cover holder 150 respectively; the lid spacer shield 125 would be positioned against the lid 65 at the first usage area 90; the lid 65 assembly with the paint roller cover 170 or brush inserted into to the first wash area 25; the drill 160 is operated for a specific period of time; the assembly of the lid 65, the drill 160 and the paint brush/roller holder 110 with the paint roller cover 170 or paint brush is lifted free from the divided tub 15, the paint brush/roller holder 110 moved to the second usage area 95 and the assembly reinserted into the second wash area 30, the drill 160 is operated for a specific period of time; the assembly of the lid 65, the drill 160 and the paint brush/roller holder 110 with the paint roller cover 170 or paint brush is lifted free from the divided tub 15, the paint brush/roller holder 110 moved to the third usage area 100 and the assembly reinserted into the third wash area 35; the drill 160 is operated for a specific period of time; the assembly of the lid 65, the drill 160 and the paint brush/roller holder 110 with the paint roller cover 170 or paint brush is lifted free from the divided tub 15, the paint brush/roller holder 110 moved to the fourth usage area 105 and the assembly reinserted into the spin dry area 40; the drill 160 is operated for a specific period of time; the assembly of the lid 65, the drill 160 and the paint brush/roller holder 110 with the paint roller cover 170 or paint brush is lifted free from the divided tub 15, the paint roller cover 170 or the paint brush is removed; and the paint brush/roller holder 110 is removed from the drill 160.

After use of the apparatus 10, the divided tub 15 is emptied of all liquid contents; the divided tub 15, the lid 65 and the paint brush/roller holder 110 is rinsed; allowed to dry, and the paint brush/roller holder 110 is placed into the storage area 45; and stored until needed again in a cyclical manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A cleaning apparatus, comprising:
- a reservoir, comprising:
  - a continuous sidewall;
  - a bottom wall;
  - a tub having an interior;
  - a plurality of divider walls subdividing said interior into a first wash area, a second wash area, a third wash area, a drying area, and a storage area;
  - a rim located about a perimeter of said sidewall;
  - at least one attachment point, each located on said rim;
  - a lid removably attached to each attachment point and covering said interior, further comprising:
  - an access travel track located thereon;
    - an entry removal point located at a terminal end of said access travel track;
    - a means for coupling a paint roller brush to a driving tool and partially inserted within said entry removal point;
- wherein a first portion of said access travel track is aligned with said first wash area, a second portion of an access travel track is aligned with said second wash area, a third portion of said access travel track is aligned with said third wash area, and a fourth portion of said access travel track is aligned with said drying area;
- wherein at least one subdivided area retains a washing solution therein;
- wherein said access travel track is aligned with at least one of said subdivided areas;
- wherein said access travel track and said entry removal point are enabling said paint roller brush to be inserted into said interior when said lid is placed on said reservoir;
- wherein said means for coupling transfers rotational force from said driving tool to said paint roller brush.

2. The cleaning apparatus of claim 1, wherein said lid further comprises a flanged perimeter mating with said rim.

3. The cleaning apparatus of claim 2, wherein said lid further comprises at least one latching handle each correspondingly mating with a respective attachment point.

4. The cleaning apparatus of claim 3, further comprising:
- a pair of attachment points each located at opposing sides of said reservoir; and
- a pair of latching handles each located at opposing sides of said lid.

5. The cleaning apparatus of claim 1, wherein said means for coupling further comprises:
- a shaft having a first end in mechanical communication with and operated by said drive tool;
- a first bearing rotatably coupled to said shaft;
- a second bearing rotatably coupled to said shaft;
- a spacer shield retained on said shaft and disposed between said first bearing and said second bearing;
- a grip disposed on said shaft, said grip adjacent said second bearing opposite said spacer shield;
- a brush holder attached to said paint roller brush; and
- a securing nut removably attached to a second end of said shaft and retaining said brush holder thereon;
- wherein said drive tool is in operable communication with said shaft, said first bearing, said second bearing, said brush holder, and said paint roller brush; and
- wherein said spacer shield has a diameter larger than a diameter of said entry removal point.

6. The cleaning apparatus of claim 1, wherein said reservoir is 17½ inches in length, 12 inches in width, and 12 inches in height.

7. The cleaning apparatus of claim 1, wherein said storage area has an area greater than said first wash area, said second wash area, said third wash area, and said drying area.

* * * * *